US010342325B2

(12) United States Patent
Moskovich et al.

(10) Patent No.: US 10,342,325 B2
(45) Date of Patent: Jul. 9, 2019

(54) ORAL CARE SYSTEM AND METHOD

(71) Applicant: COLGATE-PALMOLIVE COMPANY, New York, NY (US)

(72) Inventors: Robert Moskovich, East Brunswick, NJ (US); Matthew Kolb, Upper Black Eddy, PA (US)

(73) Assignee: Colgate-Palmolive Company, New York, NY (US)

( * ) Notice: Subject to any disclaimer, the term of this patent is extended or adjusted under 35 U.S.C. 154(b) by 161 days.

(21) Appl. No.: 15/503,650

(22) PCT Filed: Aug. 14, 2014

(86) PCT No.: PCT/US2014/051125
§ 371 (c)(1),
(2) Date: Feb. 13, 2017

(87) PCT Pub. No.: WO2016/024983
PCT Pub. Date: Feb. 18, 2016

(65) Prior Publication Data
US 2017/0238687 A1 Aug. 24, 2017

(51) Int. Cl.
*A46B 11/00* (2006.01)
*A46B 9/04* (2006.01)

(52) U.S. Cl.
CPC ..... *A46B 11/001* (2013.01); *A46B 9/04* (2013.01); *A46B 11/0034* (2013.01);
(Continued)

(58) Field of Classification Search
CPC ..... A46B 11/0062
(Continued)

(56) References Cited

U.S. PATENT DOCUMENTS 3,257,039 A * 6/1966 Trutza ..... B65D 35/285 222/102
3,917,118 A 11/1975 Odgen
(Continued)

FOREIGN PATENT DOCUMENTS

DE 34 23 400 1/1986
DE 195 34 912 3/1997
(Continued)

OTHER PUBLICATIONS

International Search Report and the Written Opinion of the International Searching Authority issued in international application PCT/US2014/051125 dated May 4, 2015.

*Primary Examiner* — David J Walczak
*Assistant Examiner* — Joshua R Wiljanen

(57) ABSTRACT

An oral care system includes a toothbrush and a dispenser detachably coupled to the toothbrush. The dispenser includes a chamber containing an oral care material. A compression device assembly includes an actuator operably coupled to a compression device movably mounted inside the dispenser. In one embodiment, the actuator may be a ratcheting rocker switch that alternatingly engages gear racks formed on the dispenser housing. Actuating the rocker switch imparts pivotable and indexed linear motion to the switch. This in turn axially translates the compression device in a first longitudinal direction thereby compressing and extruding the oral care material from the dispenser. The corresponding indexed movement of the compression device dispenses predetermined doses of the oral care material providing precise control over the amount of oral care material dispensed.

15 Claims, 11 Drawing Sheets

(52) U.S. Cl.
CPC ..... *A46B 11/0041* (2013.01); *A46B 11/0055* (2013.01); *A46B 11/0058* (2013.01); *A46B 11/0065* (2013.01); *A46B 2200/1066* (2013.01)

(58) Field of Classification Search
USPC ..... 401/154–158, 163, 186; 74/132; 222/95, 222/96, 101, 103
See application file for complete search history.

(56) References Cited

U.S. PATENT DOCUMENTS

| | | | | |
|---|---|---|---|---|
| 4,020,976 | A | 5/1977 | Mineo | |
| 4,220,260 | A | 9/1980 | Webster | |
| 4,450,982 | A | 5/1984 | Ferreira | |
| 4,763,815 | A | 8/1988 | Von Schuckmann et al. | |
| 4,826,341 | A | 5/1989 | Kwak | |
| 5,382,106 | A | 1/1995 | Voigt | |
| 6,789,703 | B2 | 9/2004 | Pierre-Louis | |
| 6,968,978 | B1 | 11/2005 | Matthews | |
| 7,237,974 | B2 * | 7/2007 | Pfenniger ..... | A46B 15/0055 401/118 |
| 9,332,829 | B2 | 5/2016 | Wu et al. | |
| 9,700,128 | B2 | 7/2017 | Kennedy et al. | |
| 2002/0114658 | A1 | 8/2002 | Allen et al. | |
| 2003/0150472 | A1 | 8/2003 | Johnson | |
| 2007/0034645 | A1 | 2/2007 | Kafcsak | |
| 2010/0290829 | A1 | 11/2010 | McCoy et al. | |
| 2011/0308030 | A1 | 12/2011 | Jimenez et al. | |

FOREIGN PATENT DOCUMENTS

| | | |
|---|---|---|
| DE | 197 05 185 | 8/1998 |
| EP | 0 248 278 | 12/1987 |
| EP | 0 612 490 | 8/1994 |

* cited by examiner

ORAL CARE SYSTEM AND METHOD

BACKGROUND

Oral care materials or agents may be applied in variety of ways. For tooth whitening products, for example, a common technique used for applying tooth whitening products is to cast an impression of a person's teeth and provide a tray of the shape of this impression. A user then adds a whitening composition to the tray and applies the tray to his/her teeth. The tray is left in place for a period of time and then removed. Another technique is to use a whitening strip that has a whitening composition on one surface. This strip is applied to a person's teeth and left in place for a period of time. Yet another technique is to apply a whitening composition to teeth using a small brush. This brush is repeatedly dipped back into the container during the application of the tooth whitening composition to one's teeth. After a few treatments, the teeth gradually whiten using the foregoing techniques.

The foregoing approaches to oral care material storage, dispensing, and application may be inconvenient and not readily portable for travel. Furthermore, it is desirable to have the ability to dispense predetermined doses of an oral care material or agent. This ensures that the proper clinically effective amount of the oral care material is used.

A more portable, compact, and convenient way to store and dispense controlled doses of an oral care material is needed.

BRIEF SUMMARY

According to one embodiment, an oral care system includes a toothbrush including a head and a handle, and a dispenser detachably coupled to the toothbrush. The dispenser includes a housing having an internal chamber and a longitudinal axis, a pair of gear racks mounted to the housing, an oral care material disposed in the chamber, a compression device movably mounted within the chamber for dispensing the oral care material, and an actuator pivotably mounted to the housing and operably coupled to the compression device. The actuator is configured to engage the gear racks and incrementally advance in a first longitudinal direction through a plurality of axial index positions defined by the gear racks. Pivoting the actuator linearly translates the compression device in the first longitudinal direction to dispense oral care material from the dispenser.

According to one embodiment, an oral care material dispenser includes a housing having an internal chamber and a longitudinal axis, a pair of gear racks mounted to the housing, an oral care material disposed in the chamber, a compression device movably mounted within the chamber for dispensing the oral care material, and an actuator pivotably mounted to the housing and operably coupled to the compression device. The actuator is configured to engage the gear racks and incrementally advance in a first longitudinal direction through a plurality of axial index positions defined by the gear racks. Pivoting the actuator linearly translates the compression device in the first longitudinal direction to dispense oral care material from the dispenser.

A method for dispensing an oral care material is provided. The method includes: providing a dispenser including a longitudinal axis, an internal chamber containing an oral care material, and a compression device movably mounted within the chamber and positioned to compress the collapsible bladder; pivoting an actuator operably coupled to the compression device in a first rotational direction about a pivot axis; linearly translating the actuator and compression device in a first longitudinal direction; compressing the oral care material with the compression device; and extruding a first dose of the oral care material from the dispenser. The method may further include pivoting the actuator in a second rotational direction about the pivot axis, further linearly translating the actuator and compression device in the first longitudinal direction, compressing the collapsible bladder with the compression device a second time, and extruding a second dose of the oral care material from the dispenser.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
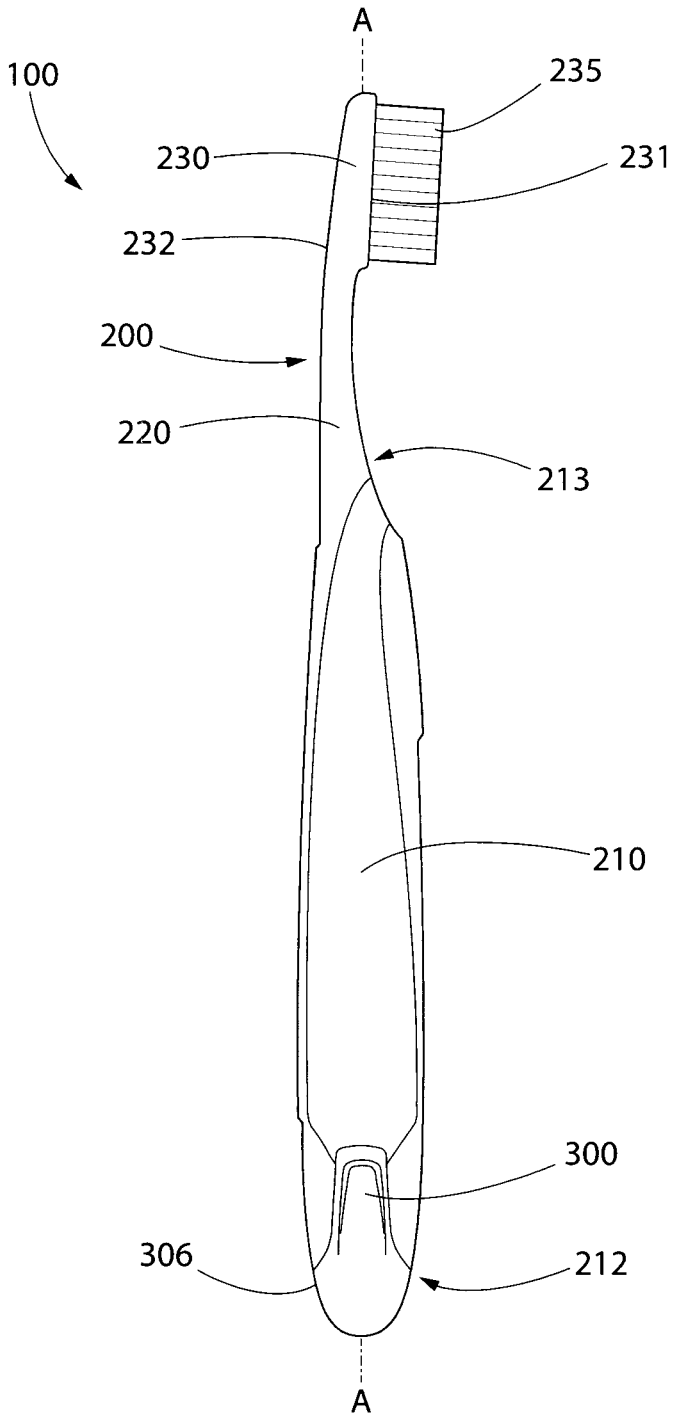
FIG. 1 is a side elevation view of an oral care system including a toothbrush and a fluid dispenser according to one embodiment of the present invention, wherein the dispenser is detachably coupled to the toothbrush.

All drawings are schematic and not necessarily to scale.

DETAILED DESCRIPTION

The following description of the preferred embodiment(s) is merely exemplary in nature and is in no way intended to limit the invention, its application, or uses. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
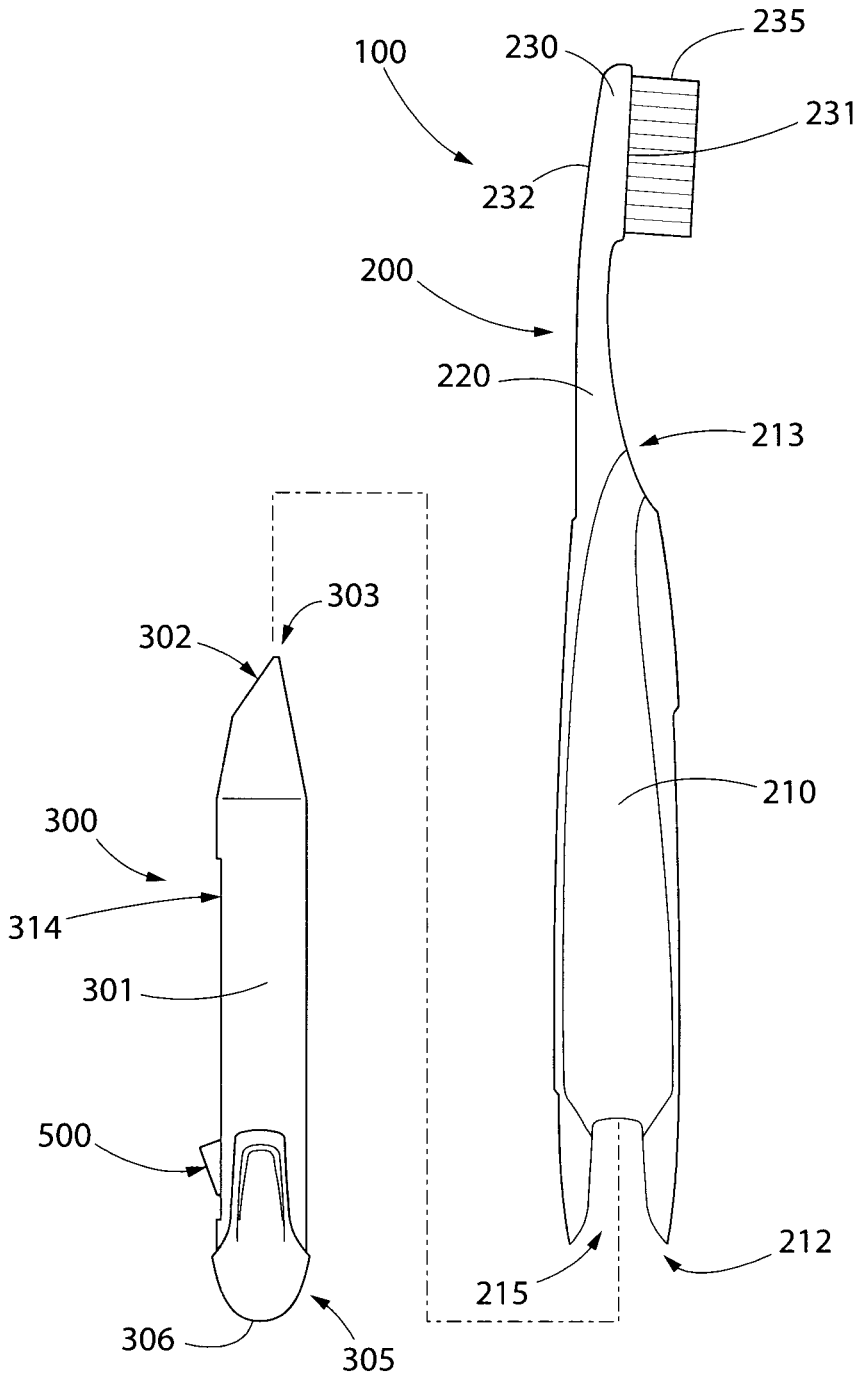
FIG. 2 is an exploded view thereof.
Figure 3:
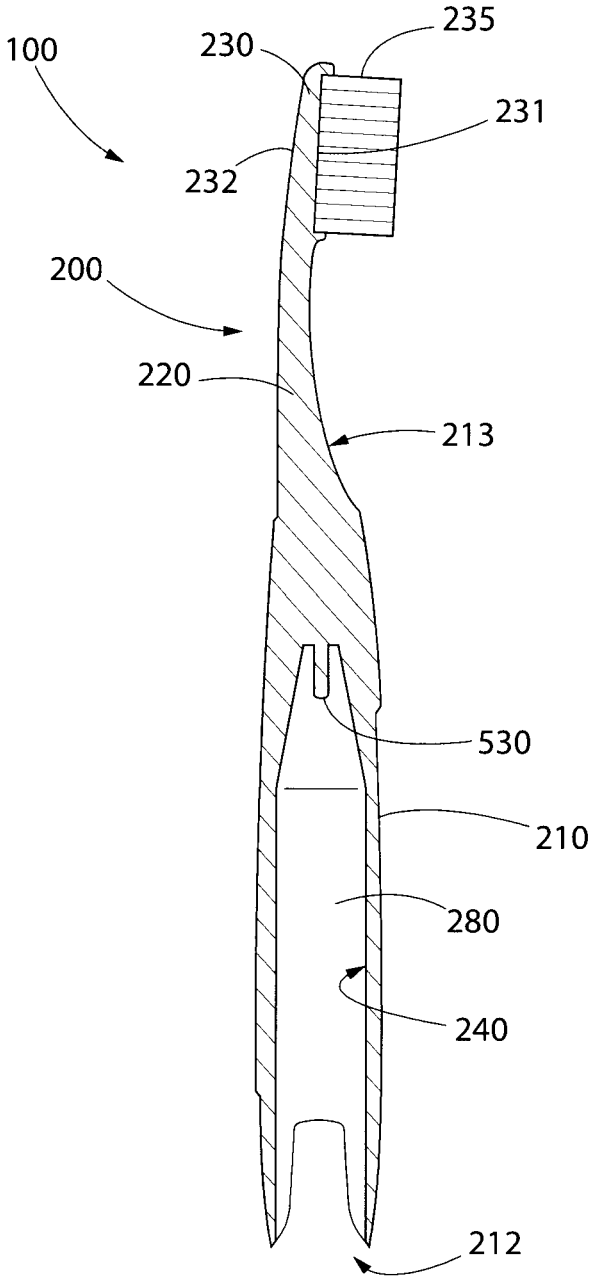
FIG. 3 is a side cross-sectional view of the toothbrush with dispenser removed.

Referring to FIGS. 1-3, an oral care system 100 according to the present invention includes an oral care device such as toothbrush 200 and an oral care material dispenser 300. In one embodiment, the dispenser 300 may be detachably stored in the toothbrush 200 as further described herein. In certain other embodiments, the dispenser 300 may not be detachably coupled (or able to be coupled) to the toothbrush 200. Rather, the dispenser 300 and toothbrush 200 may simply be sold as a kit in which the toothbrush 200 and dispenser 300 are sold in a single package.

Because, in the exemplified embodiment, the dispenser 300 is stored within the toothbrush 100, the oral care system 100 is highly portable for travel, easy to use, and reduces the amount of required luggage space. Furthermore, by housing the toothbrush 200 and dispenser 300 together, the user is less likely to misplace the dispenser 300 and more inclined to maintain the oral treatment routine with the dispenser since brushing will remind the user to simply detach and apply the contents of the dispenser 300 to complete the oral care treatment regimen.

In exemplary embodiments, the oral care material M may include without limitation the following types of flowable compositions in fluid form: tooth whitening, antibacterial, enamel protection, anti-sensitivity, anti-inflammatory, anti-attachment, fluoride, tartar control/protection, flavorant, sensate, colorant and others. However, other embodiments may be used to store and dispense any suitable type of flowable oral care material M. Accordingly, the invention is expressly not limited to any particular type of oral care material M.

With continuing reference to FIGS. 1-3, the toothbrush 200 has an elongated body and generally includes a handle 210, a neck 220 and a head 230. The handle 210 is configured for gripping by a user to manipulate the toothbrush 200 during brushing. In one embodiment, the handle 210 is configured to detachable store the dispenser 300 therein, as further described herein. Handle 210 may be formed of many different shapes, sizes, and materials formed by a variety of manufacturing methods that are well-known to those skilled in the art. If desired, the handle 210 may include a suitable textured grip made of soft elastomeric material. The handle 210 can be a single or multi-part construction. The handle 210 extends axially from a proximal end 212 to a distal end 213 along a longitudinal axis A-A of the toothbrush 200.

In one embodiment with continuing reference to FIGS. 1-3, handle 210 is an elongated and at least partially hollow structure defining an internal cavity 280 cooperatively configured with dispenser 300 to allow the dispenser to be detachably housed within the cavity until removed and deployed. An opening 215 is provided at proximal end 212 of the handle 210 that provides a passageway into the cavity through which the dispenser 300 can be inserted and retracted. While the opening 215 is located at the proximal end 212 of the handle 210 in the exemplified embodiment, the opening 215 may be located at other positions on the handle 210 in other embodiments of the invention. For example, the opening 215 may be located on a longitudinal surface of the handle 210 (e.g., the front surface, the rear surface and/or either of the opposing side surfaces) in which case the opening 215 is axially elongated to provide sufficient access to the cavity 280 for inserting the dispenser 300.

The handle 210 transitions into the neck 220 at the distal end 213. While the neck 220 generally may have a smaller transverse cross-sectional area than the handle 220, the invention is not so limited. Broadly speaking, the neck 220 is merely the transition region between the handle 210 and the head 230 and can conceptually be considered as a portion of the handle 210 or a portion of the head 230. The head 230 and/or neck 220 may therefore be considered as connected to the distal end 213 of the handle 210.

The head 230 and handle 210 of toothbrush 200 may be formed as a single unitary structure using a molding, milling, machining or other suitable process known in the art. However, in other embodiments, handle 210 and head 230 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 230 and handle 210 are of a unitary or multi-piece construction (including connection techniques) is not limiting of the present invention, unless specifically claimed. In some embodiments of the invention, a replaceable type head 230 may be provided which is detachably mounted to the handle 210 (along with a portion of neck 220) using techniques known in the art, such as disclosed in PCT International Patent Application No. PCT/US2012/042973 filed Jun. 18, 2012, which is incorporated herein by reference in its entirety.

Head 230 generally includes a front surface 231, a rear surface 232 and a peripheral side surface 233 that extends between the front and rear surfaces 231, 232. The front surface 231 of the head 230 includes a plurality of oral cleaning elements such as tooth engaging elements 235 extending therefrom for cleaning and/or polishing contact with an oral surface and/or interdental spaces. While the tooth engaging elements 235 are suited for brushing teeth, the tooth engaging elements 235 can also be used to polish teeth instead of or in addition to cleaning teeth. As used herein, the term "tooth engaging elements" is used in a broad generic sense to refer to any structure that can be used to clean, polish or wipe the teeth and/or soft oral tissue (e.g. tongue, cheek, gums, etc.) through relative surface contact.

Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Tooth engaging elements 235 of the present invention can be connected to the head 230 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

Toothbrush 200 and the dispenser 300 are non-unitary separate structures that are specially designed and configured to be detachably coupled together when in an assembled state (referred to herein as a "storage state") and completely isolated and separated from one another when in a disassembled state (referred to herein as an "application state"). The toothbrush 200 and the dispenser 300 are illustrated in the storage state in FIG. 1 and in the application state in FIG. 2. The dispenser 300 can be slidably manipulated and altered between the storage state (FIG. 1) in which the dispenser 300 is located (or docked) in the toothbrush handle 210 and the application state (FIG. 5) in which the dispenser 300 is removed from the handle 210 by the user as desired.

Figure 4:
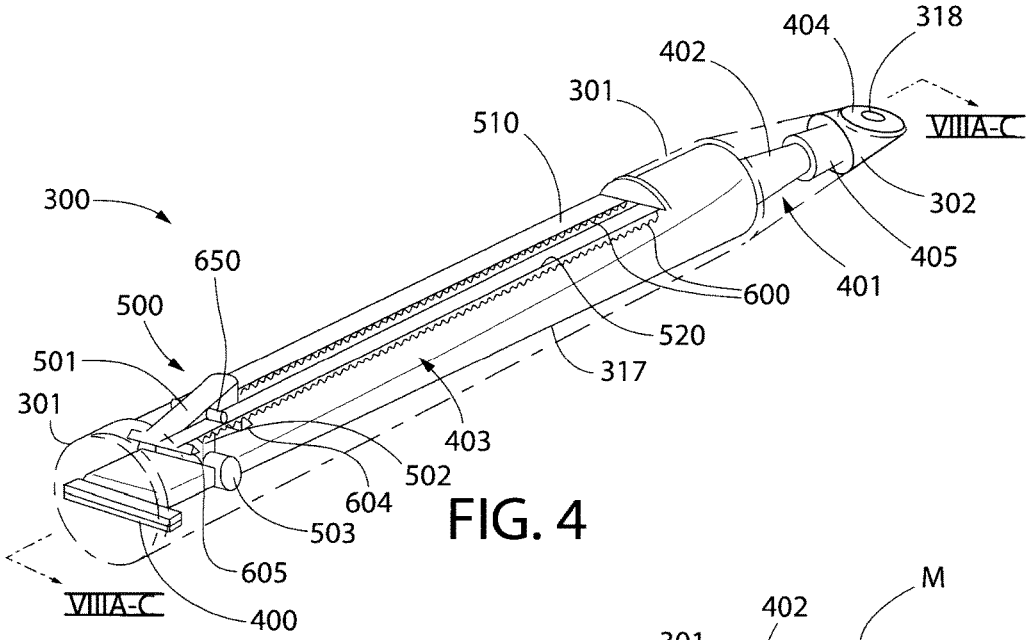
FIG. 4 is a perspective view of the dispenser with a compression device assembly.
Figure 5:
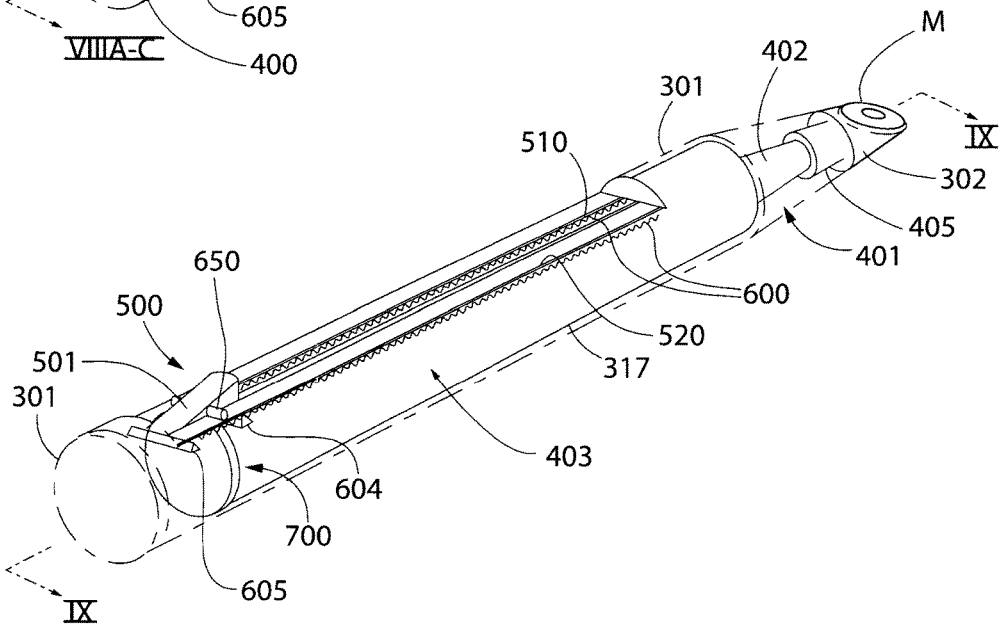
FIG. 5 is a perspective view of the dispenser showing an alternative embodiment of a compression device assembly.

FIGS. 4 and 5 illustrate one non-limiting embodiment of a dispenser 300 accordingly to the present invention. Dispenser 300 may be an elongated tubular pen-like structure that extends along a longitudinal axis B-B. The dispenser 300 comprises an elongated housing 301, an applicator 302 located in and closing an open distal end 303 of the housing 301, and a proximal end 305 of the housing 301. Distal end 303 may be considered to define a forward end or location and proximal end 305 may be considered to define a rear end or location of dispenser 300. The distal end 303 portion of dispenser 300 may be frusto-conical shaped in some embodiments.

Housing 301 may be a generally circular transverse cross-sectional profile in one embodiment. Of course, in other embodiments, the transverse cross-sectional profile of the housing 301 can take on various non-circular shapes. The housing 301 is constructed of a material and with a wall thickness that is sufficiently rigid to provide the necessary structural integrity and stiffness for handling and dispensing of an oral care material M from the dispenser 300 without substantial deformation. For example, the housing 301 can be formed of a moldable hard plastic. Suitable hard plastics include polymers and copolymers of ethylene, propylene, butadiene, vinyl compounds and polyesters such as polyethylene terephthalate. Others may be used and the invention is not limited to any particular material of construction.

While the housing 301 is exemplified as a single layer construction, in certain embodiments, the housing 301 may be a multilayer construction. In certain multi-layer embodiments, an inner layer can be formed from the hard plastic materials described immediately above while an outer layer can be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness. While an over-molding construction is one suitable method of forming the outer layer, a suitable deformable thermoplastic material, such as TPE, may be formed in a thin layer and attached to inner layer with an appropriate adhesive, sonic welding, or by other means.

Housing 301 of dispenser 300 is an elongated hollow tubular structure extending along the longitudinal axis B-B from the proximal end 305 to the distal end 303. The housing 301 comprises an outer surface 314 and an inner surface 315 that forms an elongated internal chamber 316 for holding an oral care material M. In one embodiment, the oral care material M may be directly disposed in the chamber 316. In other possible embodiments, the oral care material M may be contained within a collapsible bladder 317 disposed in the chamber 316, as further described herein. In one embodiment, proximal end 305 may be open before closure by end cap 306 thereby providing access to chamber 316 for insertion of the oral care material M, and in some embodiments the collapsible and squeezable collapsible bladder 317 which contains an oral care material M when provided. Proximal end 305 may further be closed by an end wall 406, as described herein.

With continuing reference to FIGS. 4 and 5 describing one non-limiting example of a dispenser 300 having a collapsible bladder 317, the collapsible bladder may be axially elongated extending from proximal end 305 to the distal end 303 of dispenser housing 301. A first proximal end 400 of the collapsible bladder may be sealed by a suitable means such as without limitation heat sealing, crimping, ultrasonic welding, adhesives, or other. An opposing second distal end 401 of the collapsible bladder may be terminated with a nozzle 402 having an opening or orifice formed therein for dispensing the oral care material M from the collapsible bladder 317. The collapsible bladder 317 includes flexible deformable sidewalls 403 extending circumferentially around the bladder which are structured to be compressed and collapsed by compression device 503 for dispensing oral care material M, as further described herein. In an undeformed state filled with the oral care material M, sidewalls 403 of collapsible bladder 317 may be a generally circular shape in transverse cross-section at least towards the middle and nozzled distal end 401 sections of the bladder. The collapsible bladder 317 may assume a more flattened somewhat rectangular shape near the closed proximal end 400 (see, e.g. FIGS. 8A-C). Other cross-sectional collapsible bladder shapes, however, may be provided which are useable with embodiments of the present invention.

Collapsible bladder 317 contains the desired flowable oral care material M, which can contain any active oral care agent and/or inactive ingredients. The oral care agent and/or its carrier may be in any form of a fluidic or flowable material including without limitation viscous pastes/gels or less viscous liquid compositions. Any suitable oral care material M can be stored in collapsible bladder 317 and used in the present invention. For example, the oral care material M may include any oral care agents such as without limitation oxidative or whitening agents with peroxide-containing chemical compositions which are well known in the art. Other contemplated fluidic oral care materials useable with the present invention include, without limitation: antibacterial agents; enamel strengthening or repair agents; tooth erosion preventing agents; anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents; anti-inflammatory agents; dry mouth relief ingredients; catalysts to enhance the activity of any of these agents; colorants or aesthetic ingredients; dentifrice or toothpaste; and combinations thereof. In some embodiments, the oral care material M does not contain dentifrice or toothpaste and is instead contains active agents or ingredients that provide supplemental oral care benefits in addition to merely brushing one's teeth. Other suitable fluids could include lip balm or other similar materials that are typically available in a highly viscous semi-solid yet flowable state that may be extruded from collapsible bladder 317, as further described herein.

With continuing reference to FIGS. 4 and 5, applicator 302 may include a dispensing orifice 318 through which the oral care material M stored in collapsible bladder 317 can be dispensed from the dispenser 300. In one embodiment, dispensing orifice 318 extends axially through applicator 302 and forms a fluid conduit that is in fluid communication with collapsible bladder 317 and nozzle 402 for receiving and discharging the oral care material M to the oral surfaces of the user or toothbrush 200 (e.g. toothpaste). In one embodiment, the dispensing orifice 318 may be located in a transversely angled or slanted exposed forward end wall 404 of applicator 302. End wall 404 defines and exposed surface and is angled forward and in relation to the longitudinal axis B-B, which facilitates the application of the oral care material M to the teeth, gums, lips, or other oral surfaces. The rear of applicator 302 includes a rear or proximally projecting tubular socket 405 configured for insertion of nozzle 402 from collapsible bladder 317 as shown. Tubular socket 405 fluidly and mechanically couples the collapsible bladder to the applicator 302. Socket 405 has a central passageway which is in fluid communication with nozzle 402 on collapsible bladder 317 and orifice 318. Other suitable ways of coupling nozzle 402 to applicator 302 are possible.

In certain alternative embodiments using a liquid and low viscosity oral care material M fluid, a porous applicator 302 may be provided which is constructed of a material that supports capillary fluid transport. Various porous polymeric foams or other suitable capillary materials may be used. In such embodiments, dispensing orifice 318 may be omitted as the entire porous applicator will conduct the fluidic oral care material M from the collapsible bladder nozzle 402 to the exposed surface on front wall 404 for application to the target oral tissue. Furthermore, in certain other embodiments, the dispensing orifice 318 can be located in other areas of the housing 301, such as on one of the longitudinal side walls of the dispenser 300 and/or applicator 302. In some embodiments, a plurality of dispensing orifices 318 can be provided. For example, the plurality of dispensing orifices 318 can be provided in a generally circular configuration that may be used to facilitate the fluid being dispensed through the applicator 302.

In one embodiment, applicator 302 may be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness.

In alternative embodiments, the applicator 302 may be constructed of bristles, a porous or sponge material, or a fibrillated material. Suitable bristles include any common bristle material such as nylon or PBT. The sponge-like materials can be of any common foam material such as urethane foams. The fibrillated surfaces can be comprised of various thermoplastics. The invention, however, is not so limited and the applicator 302 can be any type of surface and/or configuration that can apply a viscous substance onto the hard surface of teeth, including merely an uncovered opening/orifice.

The applicator 302 may have a generally circular transverse cross section fitted at least partially into open distal end 303 of dispenser 300. Applicator 302 may be flushed mounted with the distal end 303 of dispenser 300 in some embodiments as shown in FIGS. 4 and 5. In other embodiments, the applicator protrudes beyond the front end surfaces of the dispenser 300. Either arrangement may be used.

Referring to FIGS. 4 and 5, proximal end 305 of dispenser housing 301 may have any suitable configuration. In one embodiment, open proximal end 305 may be closed by a rear end wall 406. End wall 406 may be flat in one embodiment, or have another suitable configuration in other embodiments including angled, curved, or other. The end wall 406 may be constructed to be inserted into open end 305 of housing 301 after insertion of the collapsible bladder 317. The end wall 406 may be a separate unitary structure or in other embodiments be an integral unitary part of end cap 306 which is affixed to the proximal end 305 of the dispenser housing 301 (see also FIGS. 1 and 2).

End wall 406 of dispenser housing 301 may optionally be configured to include a clamping member 410 disposed on an interior surface inside internal chamber 316 of the dispenser 300. Clamping member 410 may have a split structure with upper and lower halves configured to grip opposing sides of the proximal end 400 of collapsible bladder 317. This holds the collapsible bladder in position during extraction of the oral care material M from the tube via compression device 503. This arrangement may be useful where the collapsible bladder 317 does not have a stiff enough structure to resist longitudinal crumpling when the oral care material M is extruded from the tube if the proximal end 400 were not affixed to the proximal end 305 of dispenser 300 via the clamping member 410. In one embodiment, the proximal end 400 of collapsible bladder 317 may be releasably affixed to proximal end 305 of dispenser 300. It will be appreciated that in some embodiments, clamping member 410 may be omitted.

Figure 8A:
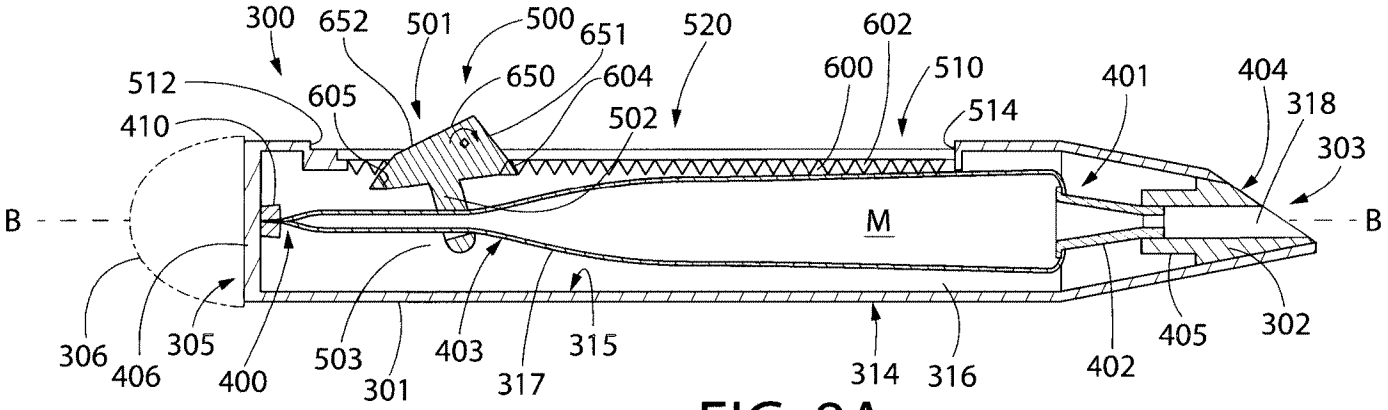
FIGS. 8A-C are side longitudinal cross-sectional views of the dispenser of FIG. 4 with the compression device assembly in different operating positions, FIGS. 8B and 8C showing an oral care material being dispensed.
Figure 8B:
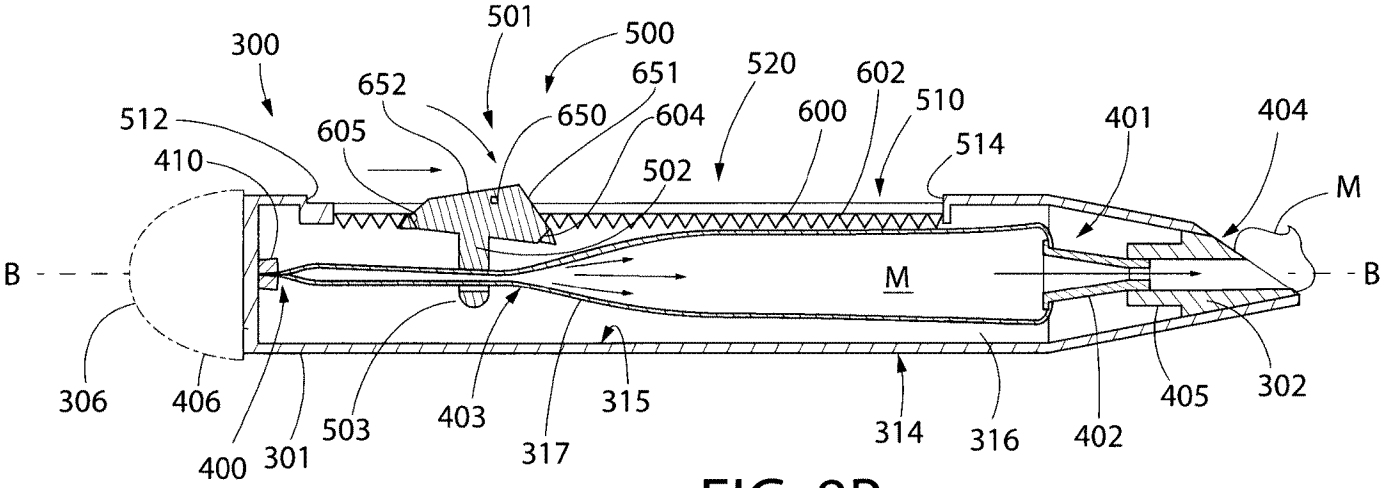
Figure 8C:
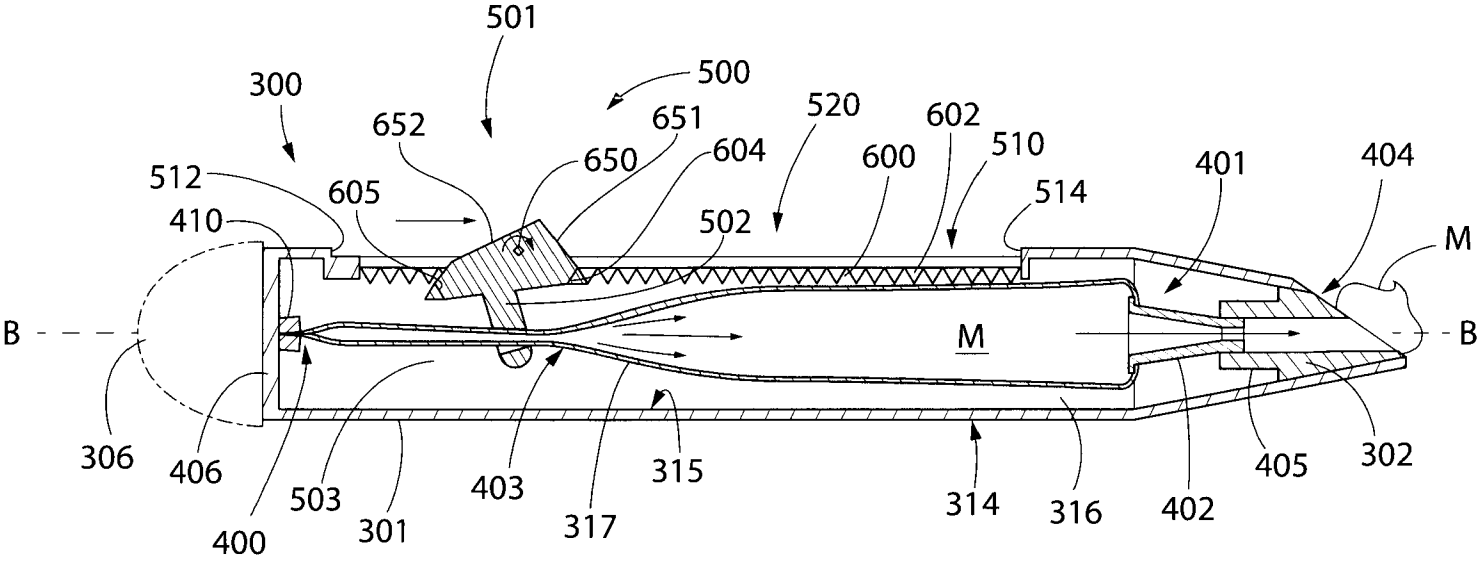
Figure 9:
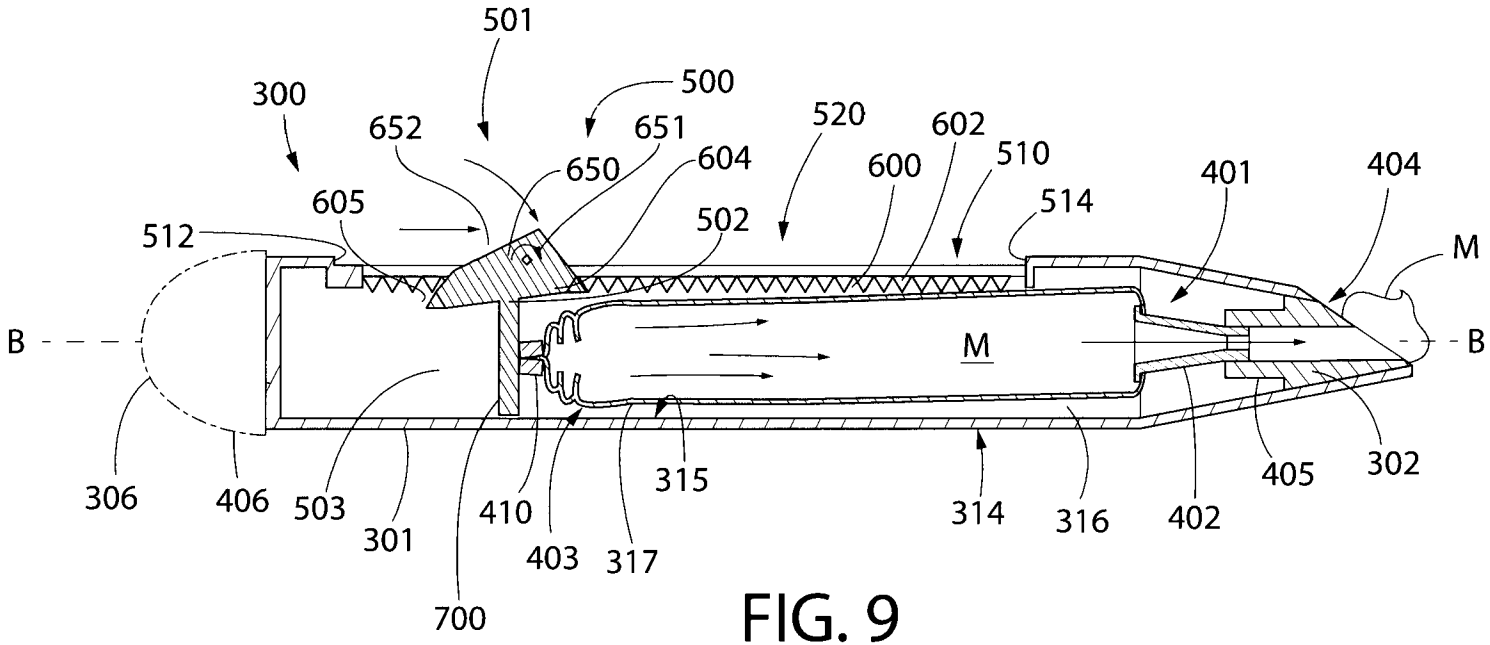
FIG. 9 is a side longitudinal cross-sectional view of the dispenser of FIG. 5 showing an oral care material being dispensed.

In one embodiment, as best shown in FIGS. 8A-C, the collapsible bladder 317 is primarily supported at the rear distal end 400 by end wall 406 of dispenser housing 301 and at the distal end 401 at nozzle 402 by applicator 302. In addition to the foregoing fixed or stationary supports, in one embodiment the collapsible bladder 317 is further supported between the ends by compression device 503 which is configured to provide a slidable intermediary support for the tube, as further described herein.

The compression device assembly 500 and the toggle switch oral care material M dispensing mechanism will now be further described below with primary reference to FIGS. 4, 6A-C, 8A-C, 10A-C, and 11A-B. In one embodiment, housing 301 of dispenser 300 includes a longitudinally-extending operating slot 520 extending between distal end 303 and proximal end 305 of dispenser 300. Operating slot 520 movably receives and retains a portion of the compression device assembly 500 which includes compression device 503. This guides the compression device 503 in a linear path along the longitudinal axis B-B of the dispenser 300. Compression device 503 is axially moveable or translatable from the proximal end 305 to distal end 303 of dispenser 300 via operation of an actuator 501, as further described herein.

Compression device assembly 500 provides a manually activated compression mechanism configured for dispensing oral care material M from collapsible bladder 317. In one embodiment, compression device assembly 500 includes actuator 501 operably coupled to compression device 503 at opposite ends of a stem 502 coupling the compression device to the actuator. The compression device 503 moves linearly in unison with the actuator 501. The compression device assembly 500 may be formed of any suitable material, including plastic or metal. In one exemplary embodiment, compression device assembly 500 may be of unitary construction being formed of injection molded plastic including appurtenances such as front and rear index protrusions 604, 605 and pivot rod 650. Compression device assembly 500 may be one piece of unitary construction or alternatively some or all of the foregoing actuator parts may be separate and joined together by any suitable method such as ultrasonic welding, adhesives, fasteners, etc.

In one embodiment, actuator 501 may be configured as a ratcheting rocker switch that is pivotably mounted to dispenser housing 301 via a pivot rod 650 that defines a pivot axis. Pivot rod 650 may comprise a single continuous rod or a pair of rod segments each extending laterally outwards from compression device assembly 500 in opposite directions to collectively form the pivot rod. Pivot rod 650 may have any suitable cross-sectional shape. In one exemplary embodiment shown in FIGS. 6A-B, pivot rod 650 may have a rectilinear cross-sectional shape (e.g. square or rectangular). Other suitable cross-sectional shapes, however, may be used including circular, ellipsoidal, or a combination of rectilinear, polygonal, and non-polygonal shapes.

In one embodiment, the two segments of pivot rod 650 may each be disposed on opposite lateral sides 653 of actuator 501 and engage corresponding flat top surfaces 510 formed on either side of operating slot 520. Top surfaces 510 may extend axially along the longitudinal axis B-B for a majority of the length of dispenser 300. The top surfaces 510 may terminate at a rear vertical wall 512 and front vertical wall 514 in dispenser housing 301. The vertical walls 512, 514 provide limit stops which restrict the maximum axial movement possible for compression device assembly 500. As convenient points of reference, top surfaces 510 define the top of dispenser housing 301. The bottom of housing 301 is defined as that part of the housing 301 lying opposite top surfaces 510 and lateral sides as the opposing parts of housing 301 extending between the top and bottom.

Actuator 501 may have any suitable configuration. In one embodiment, actuator 501 may be axially elongated in shape and have a configuration which facilitates engagement with a user's finger or thumb. In one exemplary embodiment, actuator 501 may have a generally wedge-shaped body in side elevation view (see particularly FIGS. 6A-B and 10A-C); however, other suitable shapes may be provided. At least a portion of actuator 501 has a lateral width less than the lateral width of the operating slot 520. This allows the actuator 501 to pivotably move at least partially into and out of elongated operating slot 520 in dispenser housing 301 during operation via a user pressing down on the actuator, as further described herein.

Stem 502 is affixed to the bottom of actuator 501 and may be a separate part or may be formed as an integral unitary part thereof. Stem 502 is configured and dimensioned to be inserted through operating slot 520 of dispenser 300. In one embodiment, stem 502 may have a rectilinear transverse cross-sectional shape (e.g. square or rectangular); however, other suitable cross-section shapes such as without limitation circular or ovoid may be used.

Referring to FIGS. 4 and 6A-C, compression device 503 may be laterally elongated in a direction transverse to longitudinal axis B-B preferably having a larger lateral width that the lateral width of collapsible bladder 317 at the portion engaged with feed slot 504. Compression device 503 may further have a larger lateral width than adjoining stem 502 and operating slot 520 of dispenser housing 301 in some embodiments. The compression device 503 movably disposed in internal chamber 316 of dispenser housing 301 and linearly translatable in an axial direction.

Figure 6A:
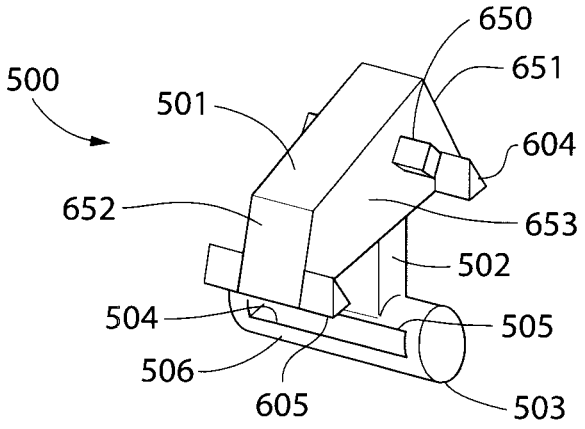
FIG. 6A is a perspective view of the compression device assembly of the dispenser shown in FIG. 4.
Figure 6B:
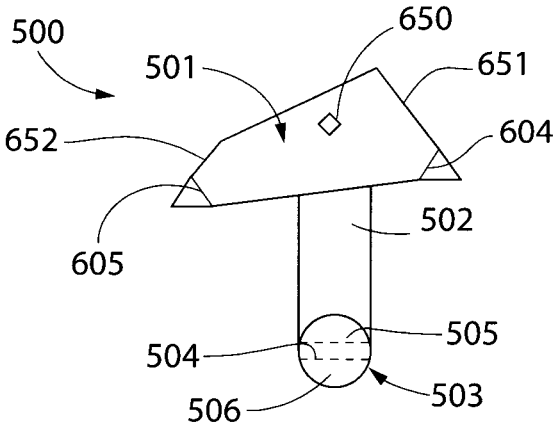
FIG. 6B is a side elevation view thereof.
Figure 6C:
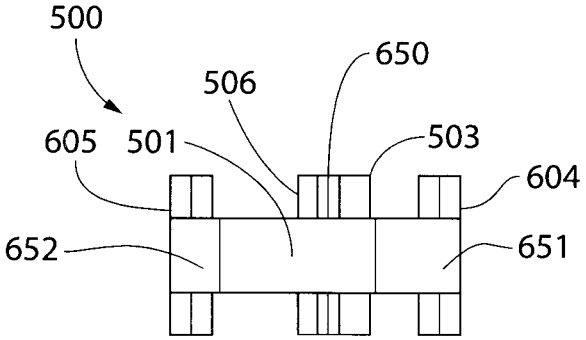
FIG. 6C is a top plan view thereof.
Figure 7A:
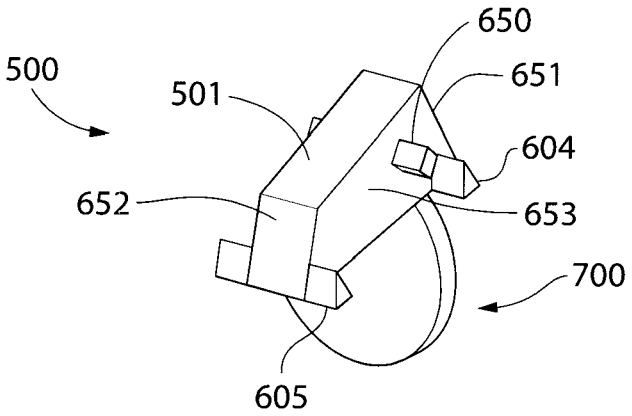
FIG. 7A is a perspective view of the compression device assembly of the dispenser shown in FIG. 5.
Figure 7B:
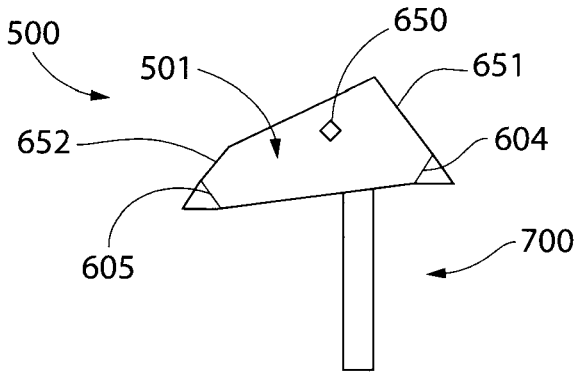
FIG. 7B is a side elevation view thereof.
Figure 7C:
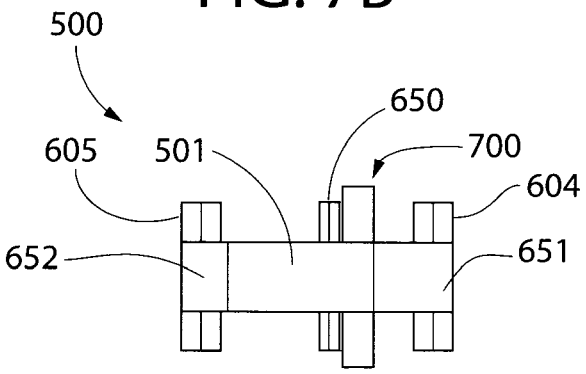
FIG. 7C is a top plan view thereof.

In the embodiment shown in FIGS. 4 and 8A-B, compression device 503 may be configured to simultaneously engage opposite sides of collapsible bladder 317 for squeezing or extruding oral care material M from the tube. In one exemplary embodiment, compression device 503 includes laterally elongated feed slot 504 defined by an upper horizontal wall 505 and opposing lower horizontal wall 506 each engaging top and bottom portions of deformable sidewalls 403 of the collapsible bladder 317. The proximal end 400 of the collapsible bladder 317 is insertable through the slot 504 allowing the compression device 503 to be progressively translated along the tube towards proximal end 401 for extruding and dispensing the oral care material M. Lateral side portions of compression device 503 adjacent slot 504 are disposed outboard of and on either lateral side of collapsible bladder 317 (see FIG. 4). In one embodiment, compression device 503 may have a generally cylindrical shape as best seen in FIGS. 6A-B. Other suitable shapes including rectilinear or block shapes, however, may be used.

FIGS. 5, 7A-C, and 9 depict an alternative embodiment of a compression device 503 in the form of a plunger 700. In one embodiment, the plunger 700 may have the configuration of a substantially flat plate which is disposed and linearly moveable in chamber 316 of the dispenser housing 301 with the actuator 501. Plunger 700 may be circular in shape or have another suitable shape to generally complement the transverse cross-section shape of internal chamber 316 of dispenser 300. Various other suitable configurations may be used. Plunger 700 may be vertically oriented in one embodiment and disposed perpendicular to longitudinal axis B-B. Plunger 700 is arranged to abuttingly engage proximal end 400 of collapsible bladder 317 and operably to dispense oral care material M. Pressing and axially advancing the actuator 501 along longitudinal axis B-B causes the plunger 700 to compress collapsible bladder 317 from the proximal end 400 forward (distally) and extrude the oral care material M from the dispenser 300. In one embodiment, clamping member 410 may be disposed on plunger 700 and is moveable therewith to compress collapsible bladder 317 (see, e.g. FIG. 8). Plunger 700 may thus be considered to form a moveable version of end wall 406 located at proximal end 305 of the dispenser 300. In other possible embodiments, the clamping member 410 may be omitted when using plunger 700 as the compression device.

To deliver predetermined and premeasured doses of the oral care material M, dispenser 300 may include a ratchet mechanism associated with the ratcheting rocker switch embodiment of actuator 501. The ratchet mechanism controls and provides incremental indexed advancement of the compression device 503 linearly along the longitudinal axis B-B of dispenser 300 through a plurality of index positions. This allows a calculated dose or amount of oral care material M to be dispensed through applicator 302 with each indexed movement of the compression device assembly 500.

Referring now to FIGS. 4-10 (inclusive of all subparts), the ratchet mechanism comprises a pair of opposing gear racks 600 disposed on dispenser housing 301 which are engaged by corresponding index protrusions formed on the ratcheting rocker switch embodiment of actuator 501. Gear racks 600 are axially elongated and extend along the length of dispenser housing 301 parallel to longitudinal axis B-B. In one embodiment, gear racks 600 may be disposed on dispenser housing 301 and spaced laterally apart on either side of elongated operating slot 520 (see, e.g. FIG. 4). Gear racks 600 may be located beneath and opposite flat top surfaces 510 formed on either lateral side of operating slot 520 in dispenser housing 301.

To produce a ratcheting action via the ratcheting rocker switch type actuator 501, compression device assembly 500 includes front and rear index protrusions 604 and 605 respectively which are each configured and arranged to engage the gear racks 600. In one exemplary embodiment, front and rear index protrusions 604 and 605 may be formed on actuator 501 as best shown in FIGS. 6A-C and 7A-C. Front and rear index protrusions 604, 605 are axially or longitudinal spaced apart on the actuator 501. Front index protrusion 604 is formed forward or distally of the pivot rod 650 and rear index protrusion 605 is formed rearward or proximally of the pivot rod (when viewing the actuator 501 mounted on the dispenser 300). In one embodiment, the front and rear index protrusions 604, 605 may be formed near or at the front and rear ends 651, 652 of the actuator 501, respectively. Both front and rear index protrusions 604, 605 are positioned beneath the gear racks 600 to engage the racks from below when the actuator 501 is mounted on the dispenser housing 301. Accordingly, front and rear index protrusions 604, 605 are disposed inside internal chamber 316 of the dispenser housing 301 when the compression device assembly 500 is fully mounted.

With continuing reference to FIGS. 4-10 (inclusive of all subparts), gear racks 600 each include a plurality of gear teeth 602 configured and arranged to engage front and rear index protrusions 604 and 605 of actuator 501. In one embodiment, the gear teeth 602 of gear racks 600 are oriented to face downwards and inwards towards internal chamber 316 of dispenser housing 301. Gear teeth 602 form a plurality of peaks and valleys between adjacent teeth as best shown in FIGS. 10A-C. Each peak defines an apex A1. The valleys are complementary configured with and to receive and engage front and rear index protrusions 604, 605 in meshed relationship. Each valley defines an axial index positions P1, P2, P3, . . . Pn where n=total number of index positions provided. The pitch spacing between apices A1 of adjacent gear teeth 602 (and concomitantly the valleys between teeth) is defined as 602*p* (see FIG. 10C), whose significance will become apparent in later. Each index position may be correlated to an amount (volumetric) or dose of oral care material M which may be dispensed from dispenser 300 with movement of the compression device assembly 500 (via actuator 501) from one index position to another index position in an axially forward or distal direction along longitudinal axis B-B, as further described herein.

The gear teeth 602 of gear racks 600 may have any suitable configuration. In one embodiment, each gear tooth 602 has an angled configuration including a forward (distal) facing front surface 602*a* and a rearward (proximal) facing rear surface 602*b*, as best shown in FIGS. 8A-C and 9. In one embodiment, each gear tooth 602 may have a generally triangular shape in transverse cross-section or side view. The gear teeth 602 form a plurality of peaks and valleys with.

Front and rear index protrusions 604, 605 may have any suitable configuration. In one embodiment, the index protrusions 604, 605 may each have a complementary configuration to gear teeth 602 formed on gear racks 600. Accordingly, front and rear index protrusions 604, 605 may each have a generally triangular shape in transverse cross-section or end view. Front and rear index protrusions 604, 605 are pivotably movable into and out of meshing engagement with the gear racks 600 via actuation of the ratcheting rocker switch type actuator 501, as further described herein.

Front and rear index protrusions 604, 605 each protrude laterally outwards from opposing lateral sides 653 of actuator 501 similarly to pivot rod 650. Index protrusions 604, 605 extend outwards a distance sufficient to engage the downward facing gear racks 600 disposed inside internal chamber 316 of dispenser 300. It should be noted that front and rear index protrusions 604, 605 and pivot rod 650 may be formed as separate structures attached to the compression device assembly 500 or may be formed as integral parts of a single unitary structure of the compression device assembly. Either construction is acceptable.

Operation of the compression device assembly 500 will now be described with respect to the embodiment of dispenser 300 including the foregoing dosing ratcheting rocker switch type actuator 501. The operation will be described initially with respect to the embodiment of compression device assembly 500 shown in FIGS. 6A-C. Additional reference is made to the dispenser 300 shown in FIGS. 4 and 8A-C.

In operation, a portion of the collapsible bladder 317 extends through feed slot 504 of compression device 503, as shown in FIGS. 4 and 8A-C. The compression device 503 simultaneously engages and compresses opposing deformable sidewalls 403 of collapsible bladder 317. Initially, the proximal end 400 of collapsible bladder 317 is inserted through the feed slot 504 when the dispenser 300 is first loaded with collapsible bladder 317 and contains a full volume or amount of oral care material M. The compression device assembly 500 is positioned more proximally near the rear or proximal end 305 of dispenser 300 in operating slot 520 and ready for dispensing.

Figure 10A:
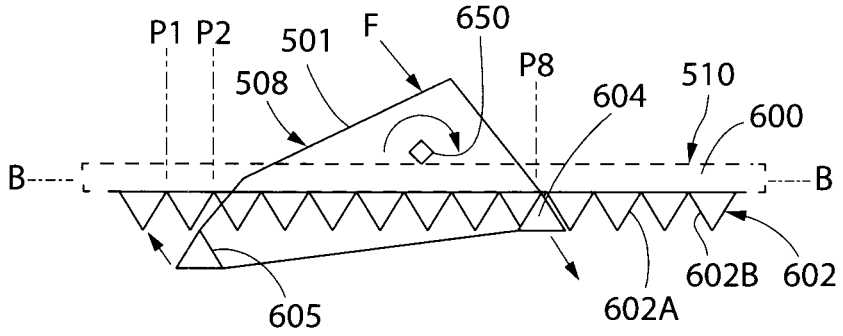
FIGS. 10A-C are schematic diagram showing side elevation views of the actuator of the compression device assembly showing various rotational operating positions of the actuator in engagement with gear racks of the dispenser for dispensing the oral care material via a pivoting ratcheting motion of the actuator.
Figure 10B:
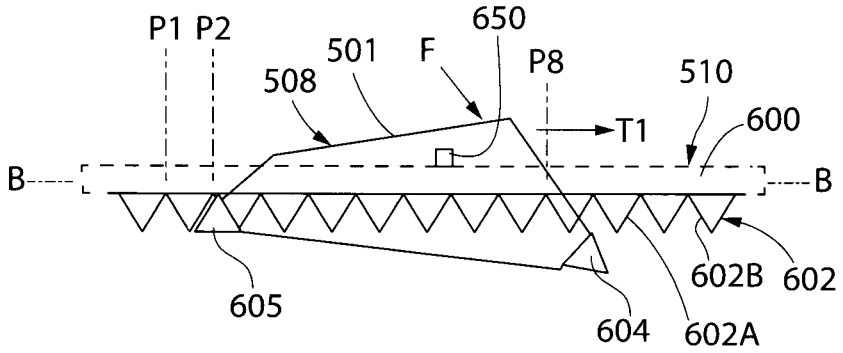
Figure 10C:
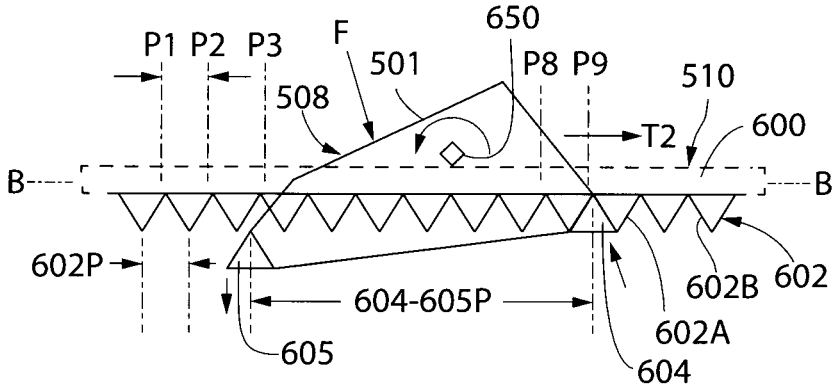

FIGS. 10A, 10B, and 10C show sequential movement steps of actuator 501 in the oral care material M dispensing process. Actuator 501 is pivotably movable from an standby position shown in FIG. 10A to a pivoted dispensing position shown in FIG. 10B, and back again to the standby position during a complete cycle of dispensing oral care material M. This dispensing cycle may be repeated numerous time until the collapsible bladder 317 is depleted. In the standby position, front index protrusion 604 is fully engaged and meshed with the gear rack 600 (i.e. gear teeth 602). Rear index protrusion 605 is disengaged from the gear rack 600 and positioned at least partially or fully below the gear rack. In the dispensing position, front index protrusion 604 is disengaged from gear rack 600 and rear index protrusion is instead engaged with the gear rack.

The dispensing process will further be described starting with the actuator 501 in the inactive non-dispensing shown for example in FIG. 10A. The exposed top surface 508 of the actuator 501 is angled and slopes downwards towards the rear (proximal) end of the actuator. The exposed top surface 508 of actuator 501 is angled with respect to top flat surface 510 of dispenser housing 301 by the largest angle in the standby position. In this embodiment, front index protrusion 604 is fully engaged with gear rack 600 and located in axial index position P8 initially. Rear index protrusion 605 is located near and slightly rear of index position P2, but not engaged with gear rack 600 as shown.

To dispense oral care material M, a user first applies a downward pressing force F with a finger or thumb onto the front portion of actuator top surface 508 located forward of the pivot rod 650 (i.e. pivot axis). This pivots the rocker switch style actuator 501 downwards and clockwise in FIG. 10A about pivot rod 650 (see directional rotation arrow). Front index protrusion 604 concurrently rotates downwards (and clockwise) away from and disengaging gear rack 600. Rear index protrusion 605 concurrently rotates upwards (and clockwise) towards engagement with gear rack 600. Actuator 501 is configured to convert this rotational or pivotal motion to linear translated motion of the actuator and compression device assembly 500 for dispensing oral care material M.

Figure 11A:
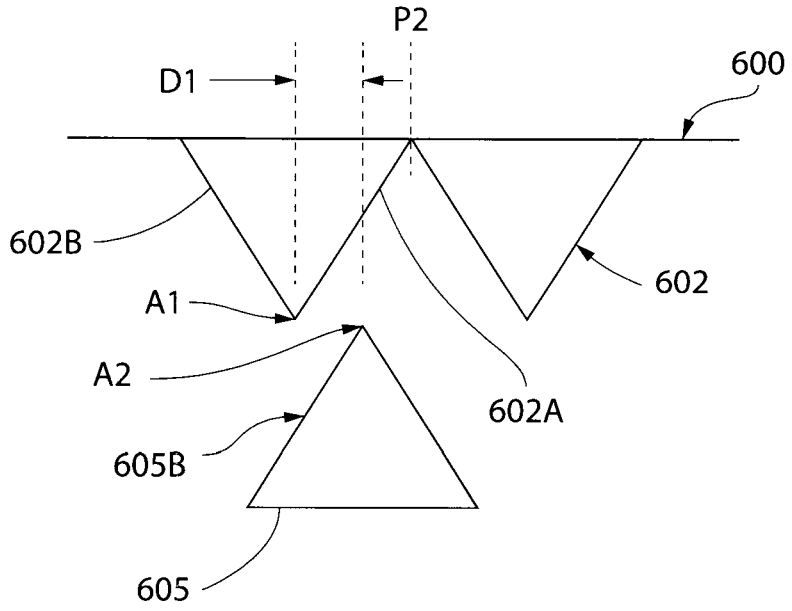
FIG. 11A is a schematic diagram showing an isolated enlarged view of the relationship between a rear index protrusion of the actuator and gear teeth of the gear rack shown in FIG. 10A.

From a design standpoint, the foregoing conversion of rotational motion to linear motion by actuator 501 may be accomplished as follows. First, in one exemplary embodiment, the pitch spacing 604-605*p* between front index protrusion 604 and rear index protrusion 605 is selected so that the spacing is not an even multiple of the pitch spacing 602*p* between the valleys of the gear rack 600. Accordingly, the apex A3 and A2 of front and rear index protrusions 604, 605 respectively cannot each simultaneously be in perfect vertical alignment with one of the valleys and corresponding axial index positions of the gear rack 600 (see, e.g. FIGS. 10A-C). For example, when front index protrusion 604 is aligned and engaged with the valley defined by index position P8 as shown in FIG. 11A, the rear index protrusion 605 is axially offset and vertically misaligned with both valleys defined by index positions P1 and P2 being located axially between these valleys and positions (see also FIG. 10A). It should be noted that pitch spacing 604-605*p* between front and rear index protrusions 604 and 605 is larger than the pitch spacing 602*p* between adjacent teeth 602 of the gear racks 600.

Second, referring to FIGS. 10A and 11A (enlarged detail of rear index protrusion 605 and portion of gear rack 600), the pitch spacing 604-605*p* is preferably selected in one embodiment so that the apex A2 of rear index protrusion 605 is axially spaced slightly forward of apex A1 for the gear tooth 602 immediately rearward of axial index position P2 (i.e. whose forward facing front surface 602*a* forms part of the P2 valley) when front index protrusion 604 is engaged with gear rack 600. Apex A1 is horizontally or axially offset by an offset distance D1 from apex A2. Offset distance D1 is therefore less than the pitch spacing 602*p* of the gear rack teeth 602. Apex A2 of rear index protrusion 605 is vertically positioned to engage a portion of the front surface 602*a* of gear tooth 602 when rear index protrusion 605 is rotated upwards and clockwise by pressing and pivoting actuator 501, as described above and shown in FIGS. 10A and 11A.

The upward movement of rear index protrusion 605 engages and slides its apex A2 upwards along forward facing front surface 602*a* of tooth 602 immediately rearward of axial position P2 (see FIGS. 10A and 11A) until the rear index protrusion becomes fully engaged and meshed with gear rack 600, as shown in FIG. 10B. This motion in turn linearly and axially translates the actuator 501 and concomitantly compression device 503 forward or distally by a first axial distance along the longitudinal axis B-B (see arrow T1). The compression device 503 squeezes and extrudes or pushes a first amount (volume) or dose of oral care material M inside collapsible bladder 317 forward towards nozzle 402. The oral care material M flows through nozzle 402 into dispensing orifice 318, and then outwards from the applicator 302 for delivery to the target oral surfaces or an oral care implement such as toothbrush 100. Advantageously, since the compression device 503 engages both upper and lower sidewalls 403 of collapsible bladder 317, the delivery of oral care material M is efficient leaving little remaining oral care material in the collapsed portion of the bladder behind (i.e. rearward or proximal) of the compression device.

As a result of the foregoing dispensing action, rear index protrusion 605 is now meshed with gear rack 600 and located at index position P2 (FIG. 10B). Front index protrusion 604 has moved axially forward of previous index position P8. In the dispensing position shown in FIG. 10B, it may be noted that the top surface 508 of actuator 501 is less steeply angled with respect to top flat surface 510 of dispenser housing 301 than in the standby position shown in FIG. 10A.

In some embodiments, the first volumetric amount of oral care material M dispensed in the foregoing manner may be considered to be a full dose. In other embodiments depending on the full volumetric amount of oral care material M intended or needed to be dispensed, the foregoing first pivotal movement (and clockwise rotation) of actuator 501 from the standby position in FIG. 10A to the dispensing position in FIG. 10B described above may be considered to dispense only a first partial volumetric amount of a predetermined full dose of oral care material M. Accordingly, the first partial amount may be about one half of a full dose. In either of the foregoing scenarios, to deliver the remaining second partial amount or half of the full dose, or alternatively a second full dose, the actuator 501 is preferably returned to the standby position shown in FIG. 10C which operates to further dispense additional oral care material M, as described below.

Figure 11B:
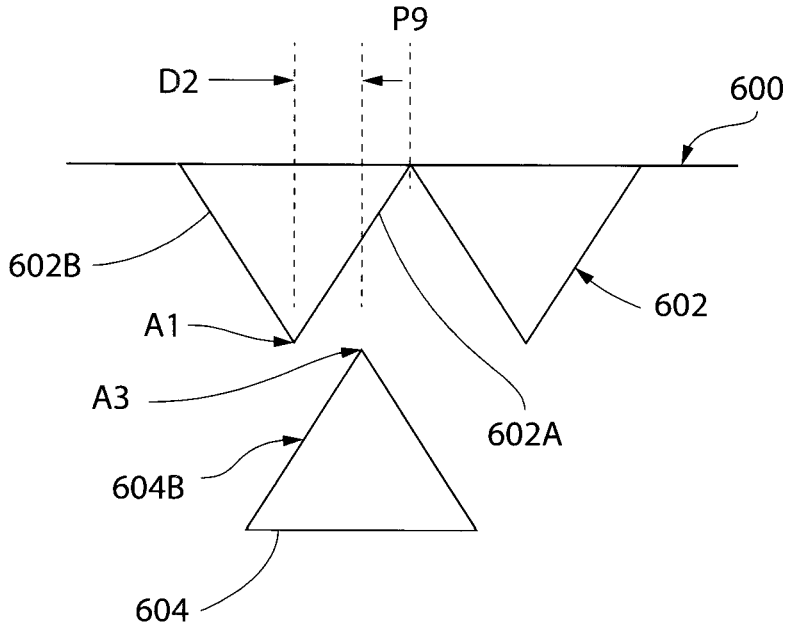
FIG. 11B is a schematic diagram showing an isolated enlarged view of the relationship between a front index protrusion of the actuator and gear teeth of the gear rack shown in FIG. 10B.

The second full dose or remaining second partial amount or half of the full does of oral care material M is dispensed by providing an offset positioning between front index protrusion 604 of actuator 501 and a gear tooth 602 of gear rack 600 in a similar manner to offset positioning of rear index protrusion 605 described above. Referring now to FIGS. 10B and 11B (enlarged detail of front index protrusion 604 and portion of gear rack 600), the pitch spacing 604-605*p* causes apex A3 of front index protrusion 604 to be spaced axially slightly forward of apex A1 for the gear tooth 602 immediately rearward of the next axial index position P9 (i.e. whose forward facing front surface 602*a* forms part of the P9 valley). Apex A1 is horizontally or axially offset by an offset distance D2 from apex A3, which in one embodiment may be the same as offset distance D1. Offset distance D2 is therefore less than the pitch spacing 602*p* of the gear rack teeth 602. Apex A3 is vertically positioned to engage a portion of the front surface 602*a* of gear tooth 602 when front index protrusion 604 is rotated upwards and counter clockwise by the user returning actuator 501 to the standby position shown in FIG. 10C, as described immediately below.

Referring to FIG. 10C, the user may return the actuator 501 to the standby position by pressing downwards with a pressing force F on the portion of actuator top surface 508 rearward of pivot rod 650. This pivots or rocks actuator 501 in an opposite rotational direction (counterclockwise). The upward movement of front index protrusion 604 engages and slides apex A3 upwards along forward facing front surface 602*a* of tooth 602 immediately rearward of axial position P9 until the rear index protrusion is fully engaged and meshed with gear rack 600, as shown in FIG. 10C. This motion in turn linearly and axially translates the actuator 501 and concomitantly compression device 503 forward or distally by a second axial distance along the longitudinal axis B-B (see arrow T2). The compression device 503 squeezes and extrudes or pushes the remaining second partial amount or half of the full dose of the oral care material M inside collapsible bladder 317 forward towards nozzle 402. The oral care material M flows through nozzle 402 into dispensing orifice 318, and then outwards from the applicator 302 for delivery to the target oral surfaces or an oral care implement such as toothbrush 100. A full dose of oral care material M has now been dispensed (comprised of the first and second partial amounts or doses), or alternatively a second full dose depending on the intended total amount of oral care material M desired, upon fully cycling the actuator 501 between the positions shown in FIGS. 10A-C.

In short, the compression device assembly 500 operably dispenses oral care material M in both the forward downward stroke of actuator 501 in a first rotational direction when pivoting actuator 501 in position from FIGS. 10A to 10B, and again in the rearward downward stroke in an opposite second rotational direction when pivoting actuator 501 in position from FIGS. 10B to 10C. Simultaneously, the compression device assembly 500 (including compression device 503) linearly translates along the dispenser 300 while the actuator 501 "walks" via forward and rearward rocking motions along the gear racks 600 and dispenser housing 301 towards the distal end 303 of the dispenser. The actuator 501 is pivotably movable in forward and rearward rotational directions about a linearly movable pivot axis (i.e. pivot rod 650) that axially travels with the actuator and is not fixed in position on the dispenser housing 301. Because the actuator 501 and compression device 503 incrementally advance axially in indexed fashion along the gear racks 600, a predetermined amount or dose of oral care material M may advantageously be dispensed with each indexed or stepped movement of the compression device assembly 500. In some embodiments, the meshing index protrusions 604 and gear teeth 602 of the gear racks 600 are configured to produce an audible "click" with each indexed movement of the compression device assembly 500. This allows the user to audibly confirm that the desired dose has been dispensed.

It will be appreciated that the user may desire and dispense only a volumetric amount or dose of oral care material M delivered by pivoting actuator 501 from the positions shown in FIG. 10A to FIG. 10B, thereby leaving the actuator 510 in the pivoted dispensing position shown in FIG. 10B before pivoting the actuator back again to the standby position shown in FIG. 10C at a future time. In addition, the user may cycle the actuator 501 several times through the positions shown in FIGS. 10A through 10C to dispense larger amounts of oral care material M if desired. The actuator 501 and compression device assembly 500 linearly advances in indexed fashion with each pivoting movement of the actuator to dispense a corresponding volume of oral care material M.

Dispensing oral care material M using a compression device assembly 500 having a compression device 503 in the form of a plunger 700 as shown in FIGS. 5, 7A-C, and 9 occurs in the same manner described above. Dispensing is still accomplished by pivoting the ratcheting rocker type actuator 501 in opposing forward and rearward rotational directions.

Mounting and dismounting of the dispenser 300 with respect to toothbrush 200 of the oral care system 100 will now be described. Referring to FIG. 1, the dispenser 300 is illustrated in the storage state. When in the storage state, the dispenser 300 is docked within the cavity 280 of the handle 210 of the toothbrush 200. An interference fit between the outer surface 314 of the dispenser 300 and an inner surface 240 of the toothbrush 200 that forms the cavity 280 detachably couples and retains the dispenser 300 to the toothbrush 200. When the dispenser 300 is in the storage state, at least a portion, and preferably a majority, of the dispenser 300 is located within the internal cavity 280 of the toothbrush 200. The end cap 306 preferably exposed and outside of internal cavity 280 to be grasped by a user for axially withdrawing the dispenser 300 from the cavity.

In the exemplified embodiment, the entirety of the housing 301 of the dispenser 300, including the applicator 302, are located within the cavity 280 of the toothbrush 200 when the dispenser 300 is in the storage state. The end cap 306 of the dispenser 300, however, protrudes axially from the proximal end 212 of the handle 210 of the toothbrush 200. This allows a user to readily grasp, axially withdraw, and deploy the dispenser. In one embodiment, the end cap 306 may be dome shaped continues the natural curved contour of the handle 210. This conceals the dispenser 300 and provides a rounded proximal end to the oral care system 100, thereby providing a look that aesthetically resembles a traditional manual toothbrush. It will be appreciated that other suitable end cap 306 shapes may be provided.

To remove the dispenser 300 in the application state shown in FIG. 2, the user merely grasps end cap 306 and axially withdraws the dispenser from internal cavity 280 of toothbrush 200. With the dispenser 300 now undocked from toothbrush handle 210, the user may dispense the oral care material M in the manner described above by axially advancing the compression device assembly 500 towards the distal end 303 of the dispenser 300. When finished, the user may then axially reinsert the dispenser 300 into internal cavity 280 of toothbrush 200. In one embodiment, an axially elongated sealing plug 530 may be disposed near the distal end of toothbrush internal cavity 280 to help seal the dispensing orifice 318 in applicator 302 when the dispenser 300 is docked in the toothbrush handle 210. The sealing plug 530 is concentrically aligned with dispensing orifice 318 when dispenser 300 is positioned inside internal cavity 280 of toothbrush handle 210. This helps prevent inadvertent dispensing or leakage of oral care material M from dispenser 300 when docked.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. An oral care system comprising:

a toothbrush including a head and a handle;

a dispenser detachably coupled to the toothbrush, the dispenser comprising:

a housing having an internal chamber and a longitudinal axis;

a pair of gear racks mounted to the housing;

an oral care material disposed in the internal chamber;

a compression device movably mounted within the internal chamber for dispensing the oral care material;

an actuator pivotably mounted to the housing and operably coupled to the compression device, the actuator including axially spaced apart front and rear index protrusions each configured to engage one of the gear racks to incrementally advance the compression device in a first longitudinal direction through a plurality of axial index positions defined by the gear racks;

wherein the gear racks have gear teeth with a first pitch spacing, and a second pitch spacing between the front and rear index protrusions is not a multiple of the first pitch spacing of the gear teeth of the gear racks; and wherein pivoting the actuator linearly translates the compression device in the first longitudinal direction to dispense oral care material from the dispenser.

2. The oral care system according to claim 1, further comprising a pivot rod which pivotably mounts the actuator to the housing, and wherein the front and rear index protrusions are disposed on front and rear portions of the actuator on opposite sides of the pivot rod.

3. The oral care system according to claim 2, wherein the pivot rod engages a flat top surface of the housing, the pivot rod being movable in the first longitudinal direction in unison with the linear translation of the compression device.

4. The oral care system according to claim 1, wherein the front and rear index protrusions are each shaped as a single gear tooth configured to engage gear teeth on the gear racks.

5. The oral care system according to claim 1, wherein the front and rear index protrusions alternatingly engage the gear racks such that when the front index protrusion is engaged with the gear rack, the rear index protrusion is not engaged with the gear rack, and vice-versa.

6. The oral care system according to claim 5, wherein an apex of the rear index protrusion is vertically aligned with a portion of a forward facing front surface of a gear tooth on the gear rack when the front index protrusion is engaged with the gear rack.

7. The oral care system according to claim 1, wherein pivoting the actuator disengages the front index protrusion from the gear racks and engages the rear index protrusion with the gear racks which linearly translates the compression device.

8. A dispenser comprising:

a housing having a longitudinal axis and a chamber containing a material;

a pair of gear racks mounted to the housing;

a compression device movably mounted within the chamber for dispensing the material; and an actuator pivotably mounted to the housing and operably coupled to the compression device, the actuator including axially spaced apart front and rear index protrusions that are each configured to engage one of the gear racks to incrementally advance the compression device in a first longitudinal direction through a plurality of axial index positions defined by the gear racks;

wherein the gear racks have gear teeth with a first pitch spacing, and wherein a second pitch spacing between the front and rear index protrusions is not a multiple of the first pitch spacing of the gear teeth of the gear racks; and wherein pivoting the actuator linearly translates the compression device in the first longitudinal direction to dispense the material from the dispenser.

9. The dispenser according to claim 8, further comprising a pivot rod which pivotably mounts the actuator to the housing, and wherein the front and rear index protrusions are disposed on front and rear portions of the actuator on opposite sides of the pivot rod.

10. The dispenser according to claim 9, wherein the pivot rod engages a flat top surface of the housing, the pivot rod being movable in the first longitudinal direction in unison with the linear translation of the compression device.

11. The dispenser according to claim 8, wherein the front and rear index protrusions alternatingly engage the gear racks such that when the front index protrusion is engaged with the gear rack, the rear index protrusion is not engaged with the gear rack, and vice-versa, and wherein an apex of the rear index protrusion is vertically aligned with a portion of a forward facing front surface of a gear tooth on the gear rack when the front index protrusion is engaged with the gear rack.

12. The dispenser according to claim 8, wherein pivoting the actuator disengages the front index protrusion from the gear racks and engages the rear index protrusion with the gear racks which linearly translates the compression device.

13. A method for dispensing a material, the method comprising:

providing a dispenser including a longitudinal axis, an internal chamber containing a material, and a compression device movably mounted within the internal chamber;

pivoting an actuator operably coupled to the compression device in a first rotational direction about a pivot axis, the pivoting of the actuator causing the compression device to translate in a first longitudinal direction to compresses the dispenser and extrude a first dose of the material from the dispenser; and wherein pivoting the actuator causes a first index protrusion on the actuator to engage a gear rack disposed on the dispenser, and wherein the gear rack includes a plurality of gear teeth arranged in a first pitch spacing, and the actuator further includes a second index protrusion engageable with the gear rack, the second index protrusion being axially separated from the first index protrusion by a second pitch spacing different than the first pitch spacing.

14. The method according to claim 13, wherein the second pitch spacing is not an even multiple of the first pitch spacing such that the first and second index protrusions cannot simultaneously engage the gear rack when one of the first and second index protrusions are engaged with the gear rack.

15. The method according to claim 13, wherein when the first or second index protrusion is engaged with the gear rack, the other index protrusion has an apex which is axially offset from an apex of at least one gear tooth of the gear rack by a distance less than the first pitch spacing.

* * * * *